US009656258B2

(12) United States Patent
Kwak et al.

(10) Patent No.: US 9,656,258 B2
(45) Date of Patent: May 23, 2017

(54) PIPETTE

(71) Applicant: Access Bio, Inc., Somerset, NJ (US)

(72) Inventors: Joon Hyeok Kwak, Belle Mead, NJ (US); Tae-Hee Koo, North Brunswick, NJ (US); Hyeonsuk Kim, Dayton, NJ (US); Young Ho Choi, Belle Mead, NJ (US)

(73) Assignee: ACCESS BIO, INC., Somerset, NJ (US)

( * ) Notice: Subject to any disclaimer, the term of this patent is extended or adjusted under 35 U.S.C. 154(b) by 144 days.

(21) Appl. No.: 14/141,901

(22) Filed: Dec. 27, 2013

(65) Prior Publication Data

US 2014/0186235 A1 Jul. 3, 2014

Related U.S. Application Data

(60) Provisional application No. 61/746,970, filed on Dec. 28, 2012.

(51) Int. Cl.
*B01L 3/02* (2006.01)

(52) U.S. Cl.
CPC ..... *B01L 3/021* (2013.01); *B01L 2200/0605* (2013.01); *B01L 2300/0838* (2013.01); *B01L 2400/0406* (2013.01); *B01L 2400/0481* (2013.01)

(58) Field of Classification Search
USPC ..... 422/520
See application file for complete search history.

(56) References Cited

U.S. PATENT DOCUMENTS

| | | | | |
|---|---|---|---|---|
| 672,207 | A * | 4/1901 | Dunn | 604/299 |
| 2,728,232 | A * | 12/1955 | Bremmer | 73/864.15 |
| 2,941,869 | A * | 6/1960 | Brown et al. | 422/401 |
| 3,938,392 | A | 2/1976 | Rodrigues | |
| 5,775,546 | A * | 7/1998 | Buehler | 222/209 |
| 6,343,717 | B1 | 2/2002 | Zhang et al. | |
| 6,531,098 | B1 | 3/2003 | Kenney | |
| 6,803,021 | B1 * | 10/2004 | Bertling | 422/514 |
| 7,858,037 | B2 * | 12/2010 | Flaherty | 422/68.1 |
| 2003/0000970 | A1 * | 1/2003 | Pameijer et al. | 222/207 |
| 2005/0112776 | A1 * | 5/2005 | Clark | B01L 3/0275 436/180 |
| 2009/0301232 | A1 | 12/2009 | Clark et al. | |

(Continued)

FOREIGN PATENT DOCUMENTS

EP 0796659 A2 9/1997

OTHER PUBLICATIONS

PCT International Search Report; International Application No. PCT/US2013/078066 mailed Apr. 22, 2014.

(Continued)

*Primary Examiner* — Jill Warden
*Assistant Examiner* — Brittany Fisher
(74) *Attorney, Agent, or Firm* — Lucas & Mercanti, LLP

(57) ABSTRACT

A pipette for delivering a measured volume of liquid having an elongated hollow tubular body (or capillary tube) (2) configured to draw liquid by capillary action, the hollow tubular body having a lower open end and an upper open end; and a chamber (3) structurally connected to the upper end of the tubular body (2), the chamber having an orifice (4) in the upper portion of the chamber.

20 Claims, 16 Drawing Sheets

(56) References Cited

U.S. PATENT DOCUMENTS

| | | | | |
|---|---|---|---|---|
| 2009/0317304 | A1* | 12/2009 | Hirafuji et al. | 422/100 |
| 2011/0129396 | A1* | 6/2011 | Fish | 422/507 |

OTHER PUBLICATIONS

PCT Written Opinion of the International Searching Authority; International Application No. PCT/US2013/078066 mailed Apr. 22, 2014.

PCT International Preliminary Report on Patentability; International Application No. PCT/US2013/078066 mailed Jun. 30, 2015.

Chinese Office Action (English Translation included) Application or Patent No. 2013800650889, Issuing No. 2017011801586080, Issue Date: Jan. 22, 2017 Applicant or Patentee: Access Bio, Inc. Title: Pipette.

* cited by examiner

Side

Side

PIPETTE

CROSS-REFERENCE TO RELATED APPLICATION

This application claims the benefit of priority from U.S. Provisional Patent Application No. 61/746,970 filed Dec. 28, 2012, the contents of which are incorporated herein by reference.

FIELD OF THE INVENTION

The invention relates to a pipette for collecting and subsequent dispensing of a precise quantity of fluid.

BACKGROUND OF THE INVENTION

Pipettes and capillary tubes have long been used to collect and dispense fluids. Various types of devices are known for dispensing a volumetric quantity of liquid, such as standard glass and plastic pipettes, serological pipettes, calibrated capillary tubes, conventional medicine or eye droppers, air and positive displacement pipettes and syringes. These devices are, for the most part, inaccurate or expensive to manufacture.

Pipettes generally involve a tube of glass having a narrowed or restricted tip at one end and a soft or flexible bulb assembled onto the opposite end. While the volume of liquid involved in such film or droplets may appear quite small, it is desirable to have pipettes designed to handle quantities measured in micro-liters without introducing unwanted errors.

SUMMARY OF THE INVENTION

The present invention provides for a uniquely configured device so as to precisely control the flow paths of air and fluid within the pipette so as to positively preclude the accidental dispensing of a volumetric quantity of fluid greater or less than the volume of the capillary tube portion of the device. The pipette is designed to draw an accurate amount of sample from a pool of greater volume, where the volume drawn in is restricted by the capillary tube of the invention. The present invention further provides for a pipette in which the volume of liquid dispensed is a direct function of the inside diameter and length of the tubular portion of the capillary tube of the pipette.

With the present invention, an accurate and precisely measurable volume of liquid is represented by the volume of the capillary tube including both its narrowed or restricted end and by drawing in sufficient liquid. In the case where overflow of sample is collected, the overflow goes into the middle tube extension portion of the chamber so as to allow a precise measurement to be obtained without exercise of any degree of care.

In connection with this, there is disclosed a means for obtaining the desired capacity of the pipette, through the specific measurement of length and diameter of the capillary tube, whereby the ultimate capacity of the pipette may be readily determined. For example, the capillary tube can be of such a length and diameter so as to allow retaining from about 0.1 μL to about 200 μL. For this purpose, the capillary tube is molded as a separate element and fixed to the bottom tube extension of the chamber via frictional fit, bonding or by any other method known in the art which allows for the integral assembly of the capillary tube to the bottom tube extension of the chamber.

The present invention also provides for a pipette that can dispense precise amounts of fluid from the pipette using bulbs. While the sample can be collected into the capillary tube, the drawing technique provided by the present invention prevents unwanted air into the capillary tube, thereby preventing air bubbles being ejected with the sample and providing inaccurate readings. For example, the lower bulb in a double-bulb pipette, or the lower portion of the bulb in a single bulb pipette, can aid in the removal of air bubbles from the capillary tube.

DETAILED DESCRIPTION OF THE INVENTION

The present invention provides for a pipette for delivering a precisely measured volume of liquid having:

an elongated hollow tubular body, or capillary tube (2), configured to draw liquid by capillary action, the hollow tubular body having a lower open end and an upper open end; and a chamber (3) connected to the upper end of the tubular body, the chamber having an orifice (4) in the upper portion of the chamber;

wherein, the chamber extends to a middle tube extension (3-*c*-*i*) and continues to a bottom tube extension (3-*c*-*ii*); and the bottom tube extension being integrally united to the hollow tubular body or capillary tube at the lower end of the bottom extension. The orifice can be made through only one side or, alternatively, on both sides (opposite to each other) of the chamber at a selected distance from the open end.

In one particular embodiment there is provided a pipette for delivering a measured volume of liquid having:

a capillary tube (2), configured to draw liquid by capillary action, the capillary tube having a lower open end and an upper open end; and a chamber (3) connected to the upper end of the capillary tube; the chamber comprising an upper bulb (3*a*) and a lower bulb (3*b*), wherein the upper bulb comprises an orifice (4). The orifice can be made through only one side or, alternatively, on both sides (opposite to each other) of the upper bulb of the chamber.

Figure 1:
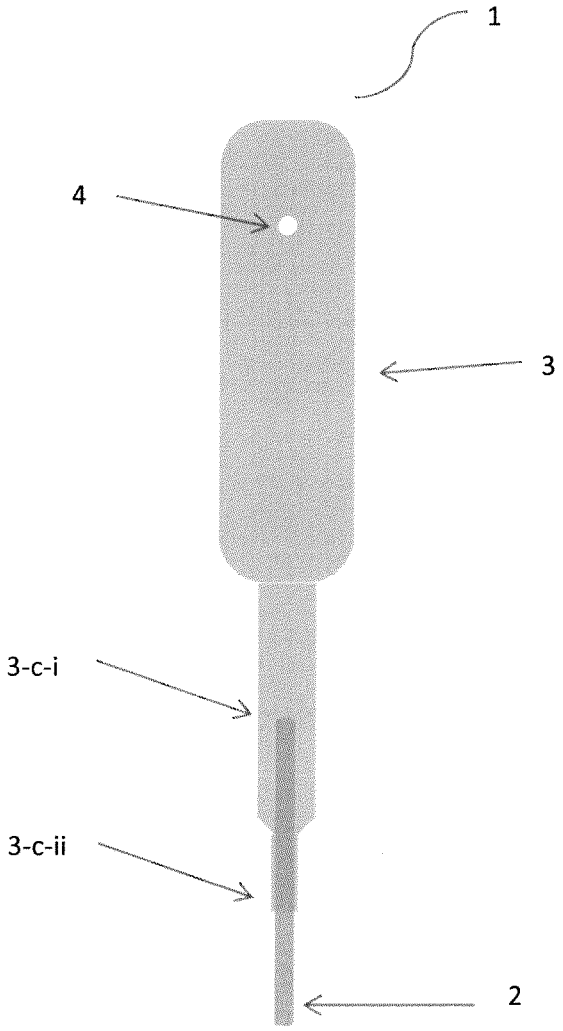
FIG. 1 is a pipette according to one embodiment of the present invention.
Figure 3:
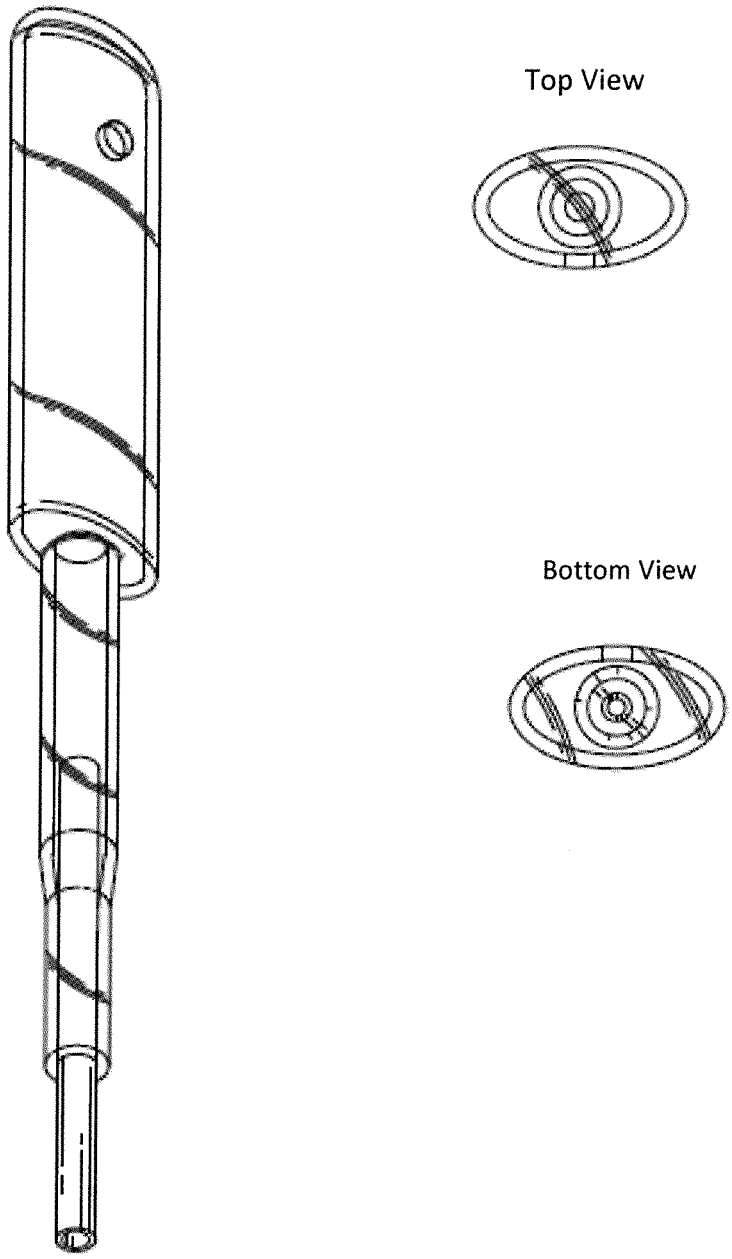
FIG. 3 provides different views of a pipette according to the embodiment of FIG. 1.
Figure 4:
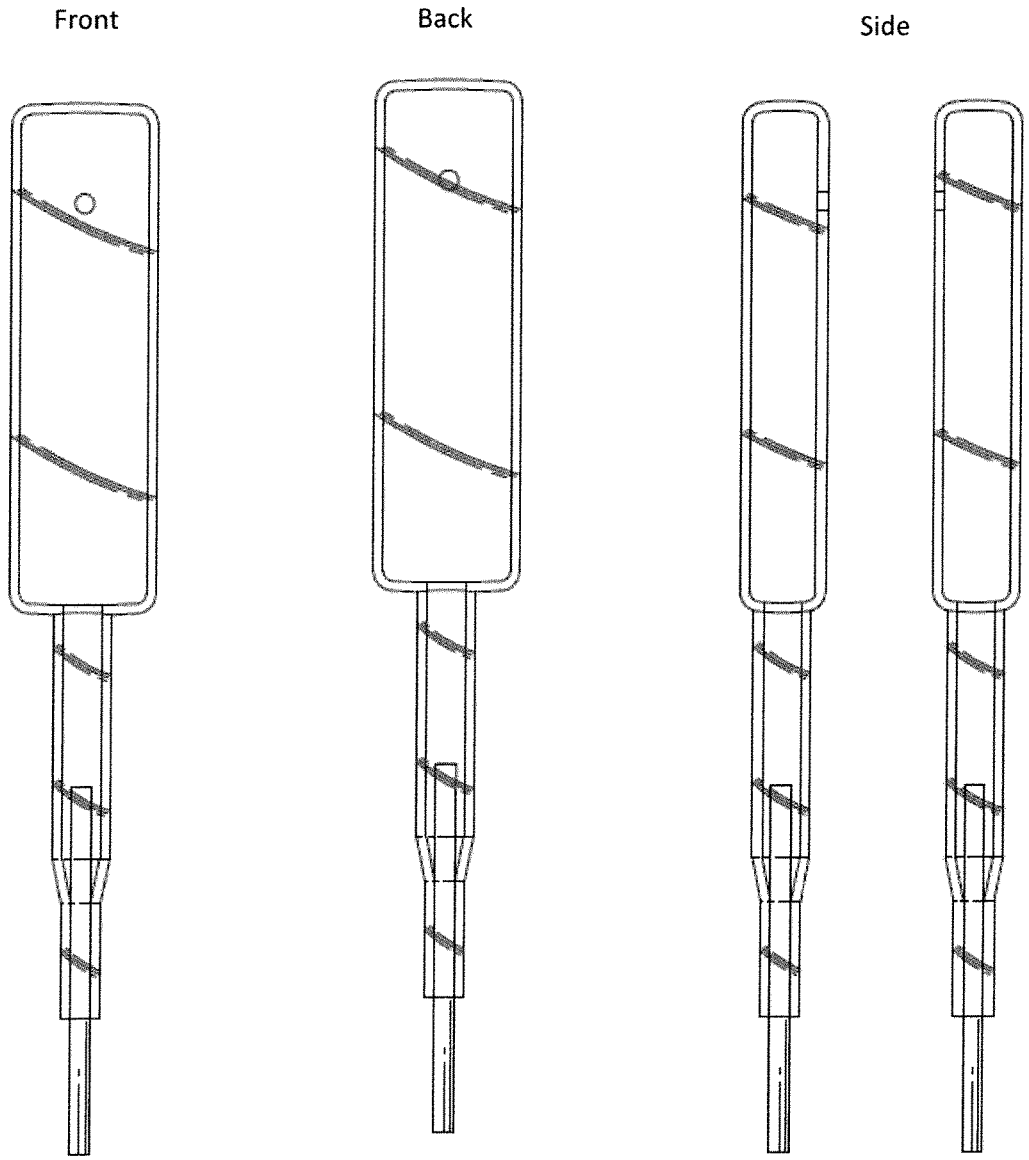
FIG. 4 provides different views of a pipette according to the embodiment of FIG. 1.

In one embodiment and as provided in FIGS. 1, 3 and 4, there is provided a pipette (1) for delivering a measured volume of liquid having:

an elongated hollow tubular body or capillary tube (2) configured to draw liquid by capillary action, the hollow tubular body having a lower open end and an upper open end; and a chamber (3) structurally connected to the upper end of the tubular body (2), wherein, the chamber having two quadrilateral shaped sidewalk slightly curved such that when the sidewalk are facing each other and connected together by all four corners of the quadrilateral shaped sidewalk the chamber has quadrilateral shaped sidewalls and an oval shaped inner area;

there is an orifice in the upper portion of one sidewall or both sidewalls of the chamber;

the chamber extends to a middle tube extension and continues to a bottom tube extension; the bottom tube extension being integrally united to said capillary tube at the lower end of said bottom extension;

the orifice on the one sidewall, or alternatively on both sidewalls, of the chamber being of a diameter such that the orifice is coverable with a finger or fingertip of the user; and the elongated hollow tubular body (or capillary tube) (2) having a diameter and a height of a predetermined measurement such that a precise collection of from about 0.1 μL to about 200 μL of a liquid is drawn by capillary action.

In another embodiment, there is provided a pipette as described above and as provided in FIGS. 1, 3 and 4, wherein the middle tube extension has a diameter smaller than the chamber's diameter and continues to the bottom tube extension having a smaller diameter than the middle tube extension.

Figure 13:
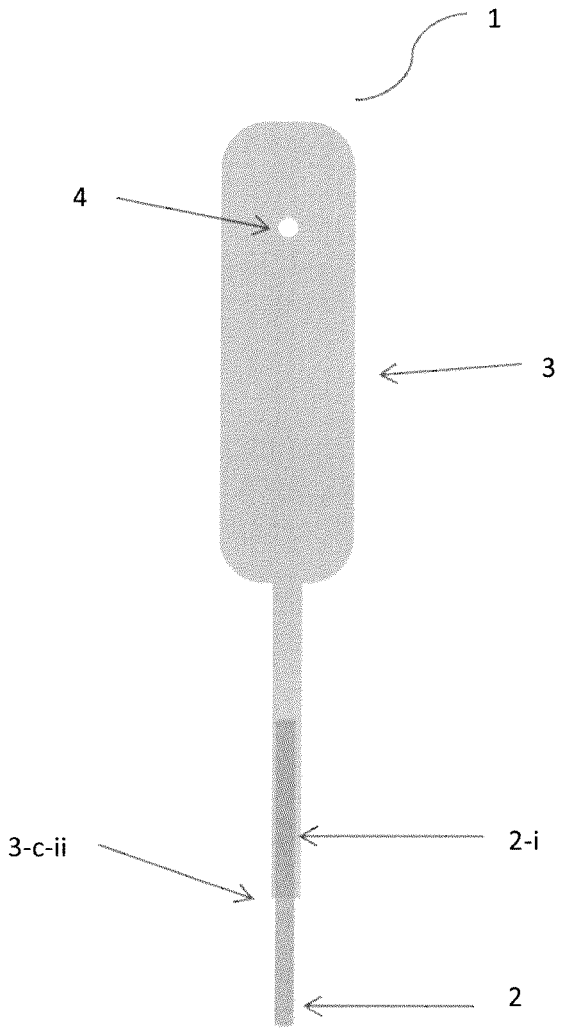
FIGS. 13-16 are pipettes according to other alternative embodiments of the present invention.
Figure 14:
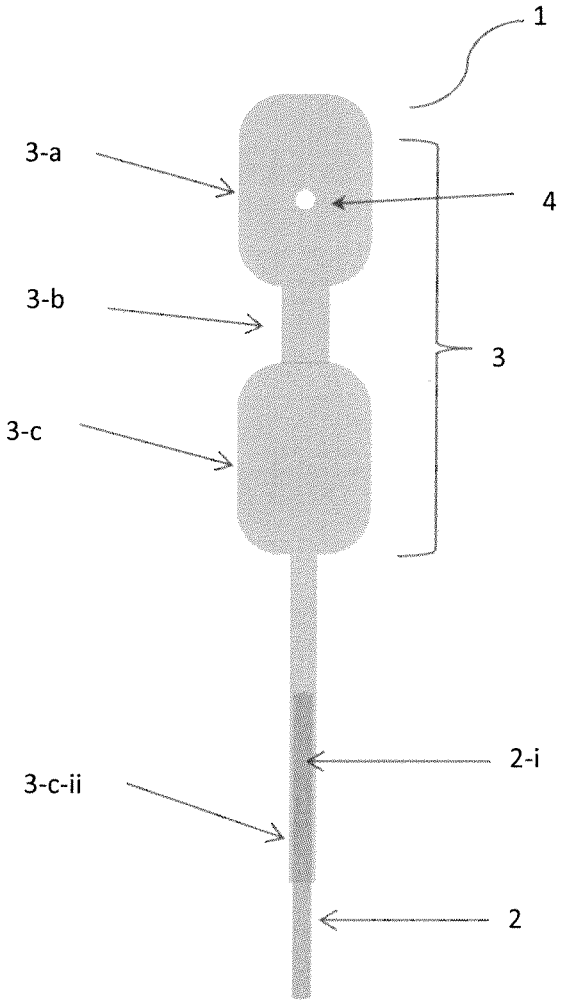

In an alternative embodiment, there is provided a pipette substantially as described above and as provided in FIGS. 13 and 14 wherein the chamber extends directly to a bottom tube extension.

Figure 2:
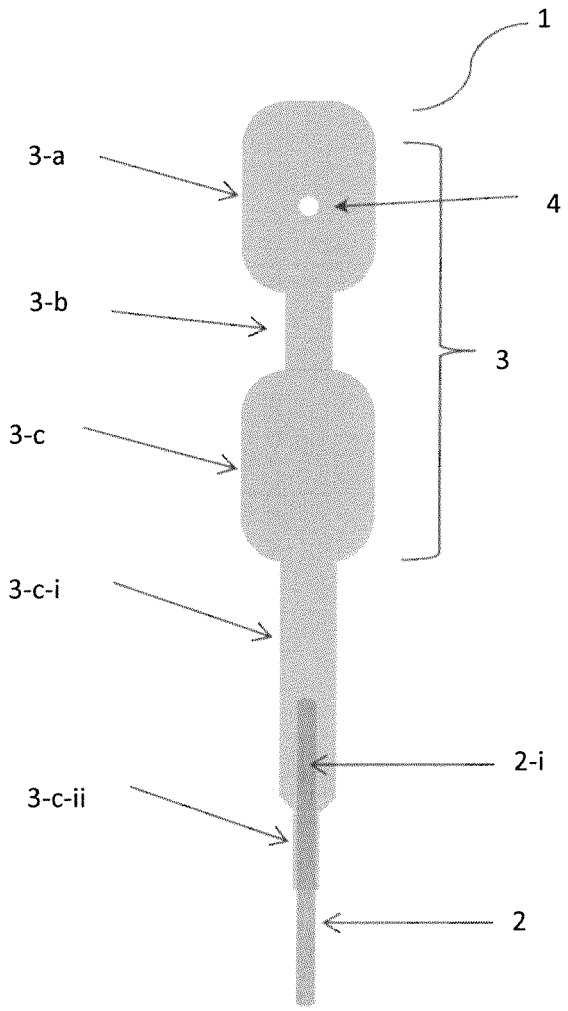
FIG. 2 is a pipette according to another embodiment of the present invention.
Figure 5:
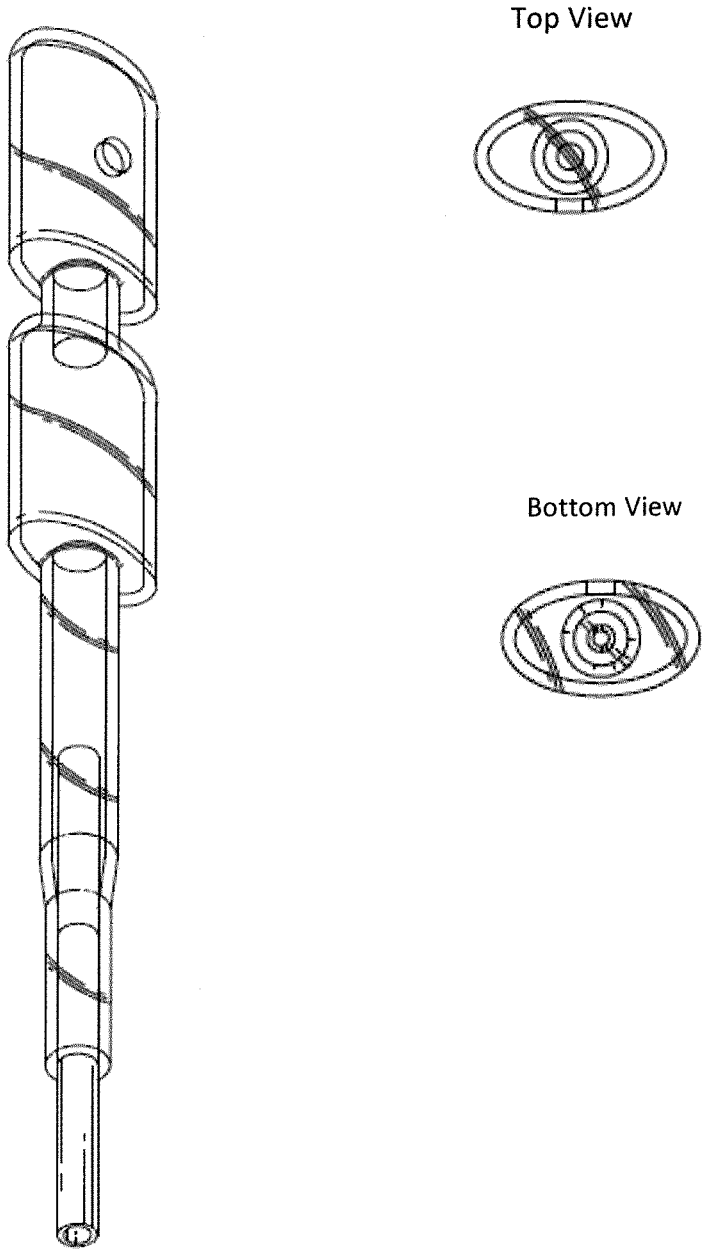
FIG. 5 provides different views of a pipette according to the embodiment of FIG. 2.
Figure 6:
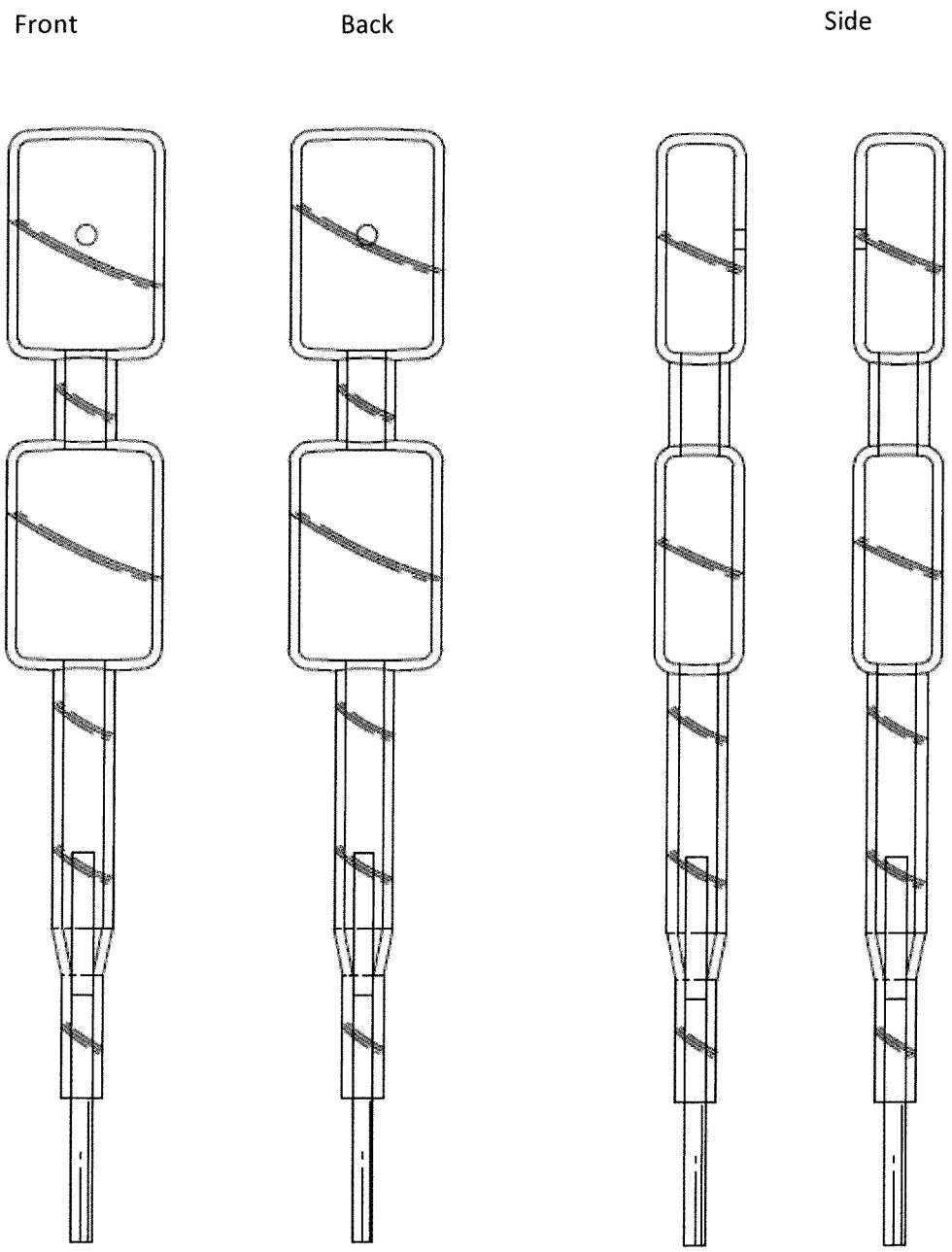
FIG. 6 provides different views of a pipette according to the embodiment of FIG. 2.
Figure 7:
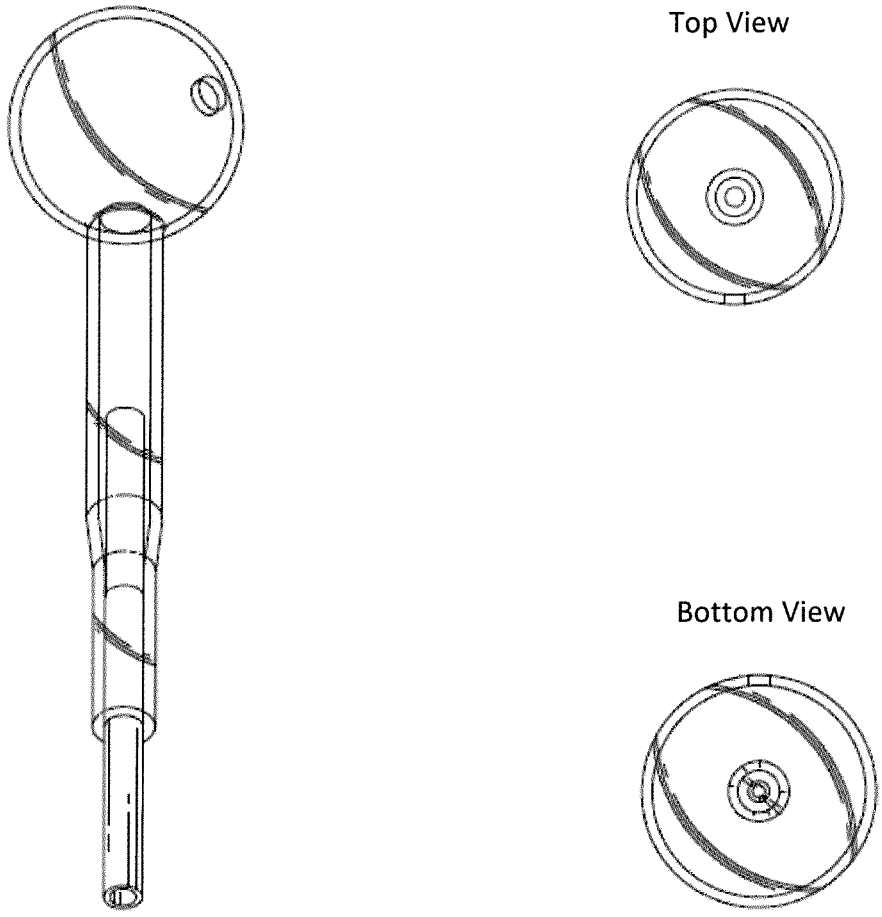
FIG. 7 is a pipette according to an alternative embodiment of the present invention.
Figure 8:
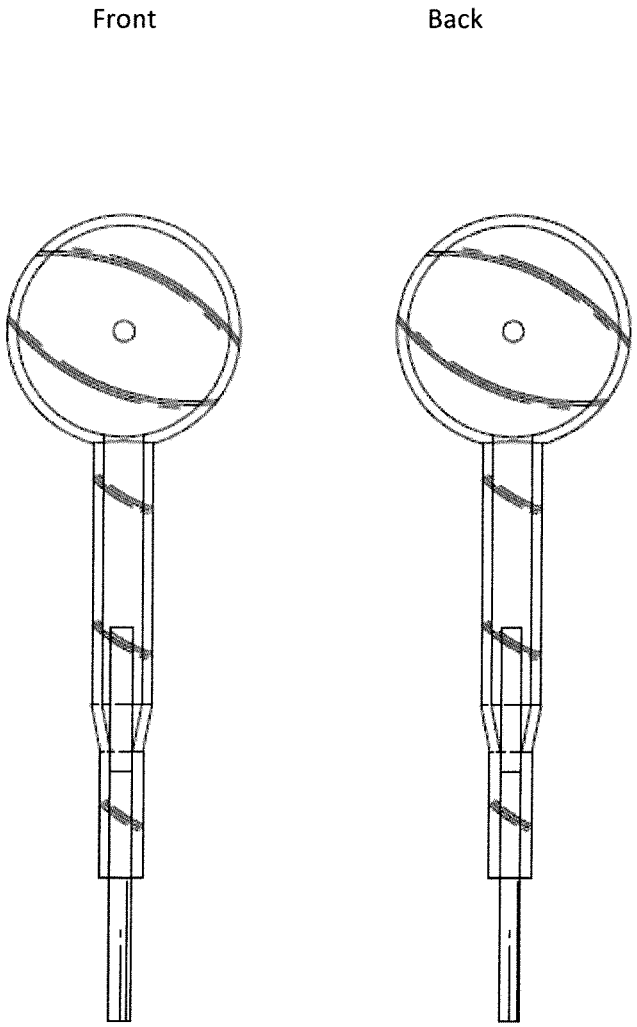
FIGS. 8-9 provide different views of the pipette of FIG. 7.
Figure 9:
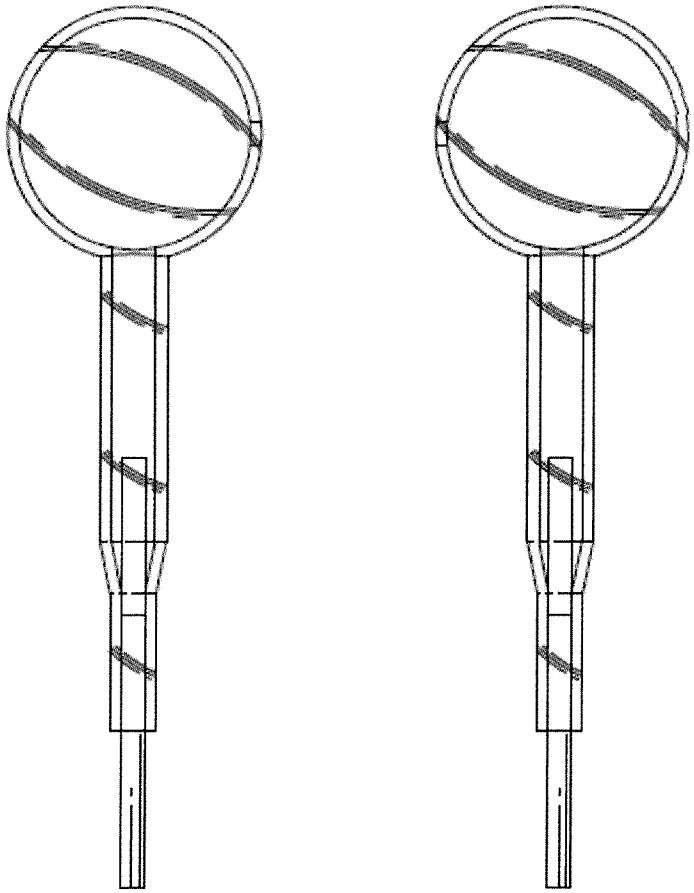
Figure 10:
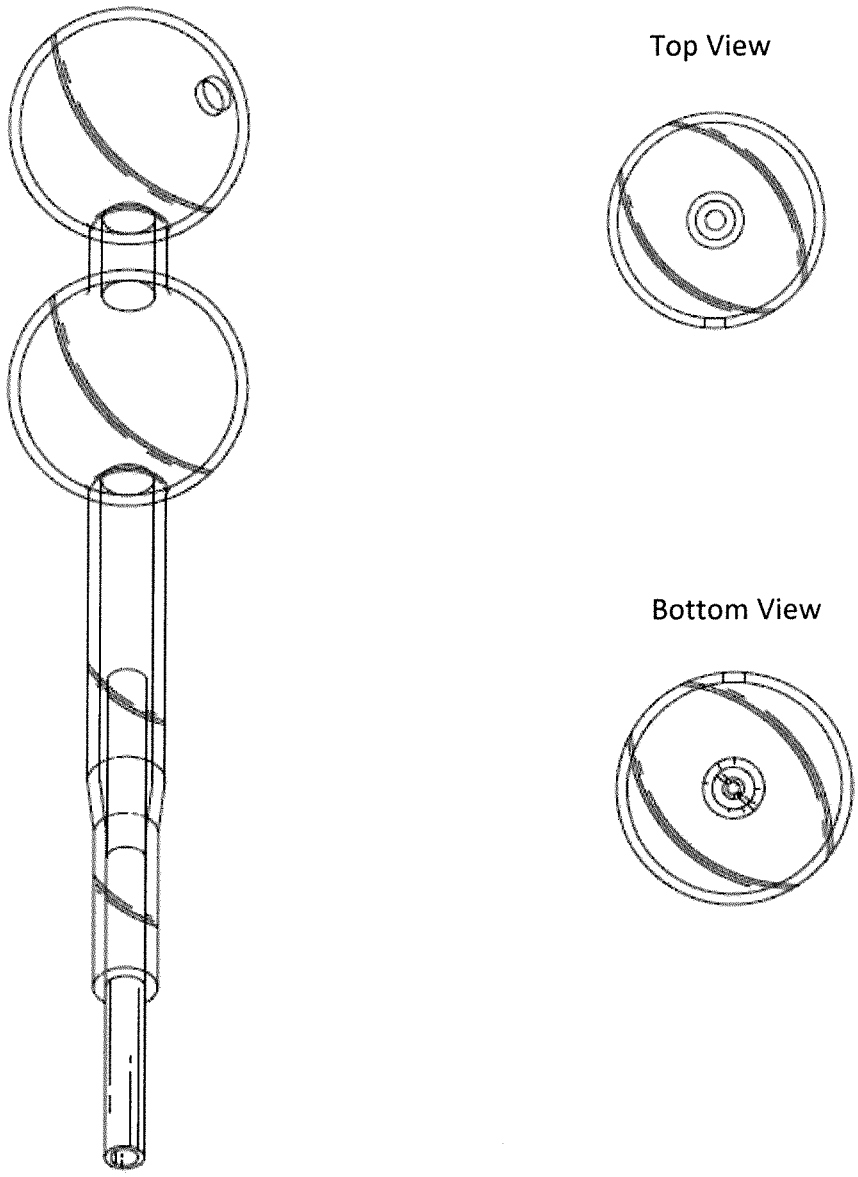
FIG. 10 is a pipette according a further alternative embodiment of the present invention.
Figure 11:
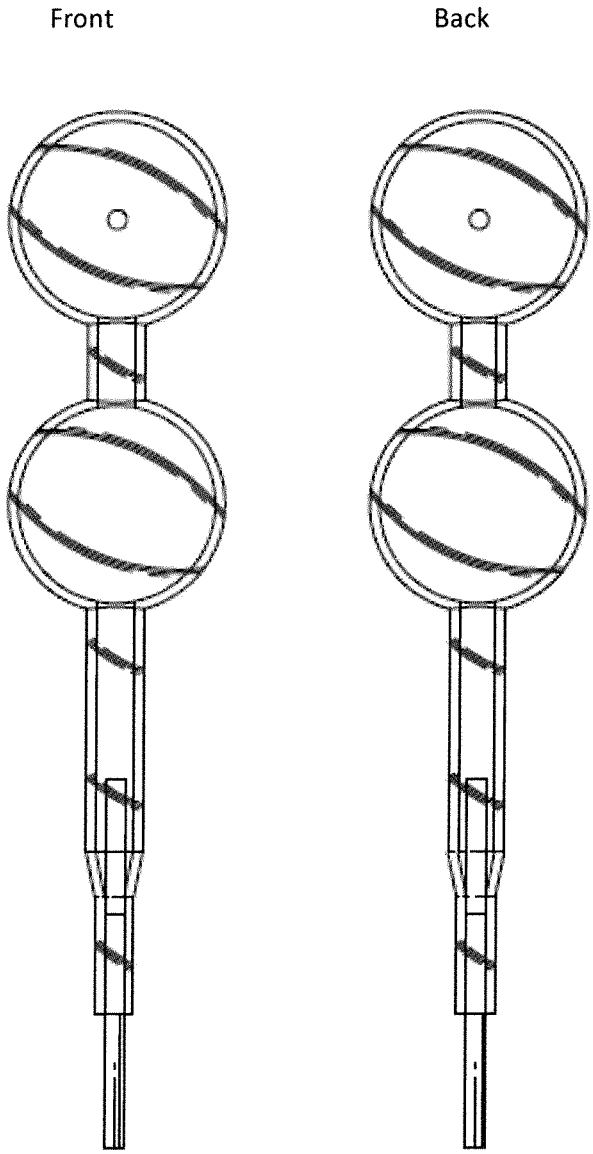
FIGS. 11-12 provide different views of the pipette of FIG. 10.
Figure 12:
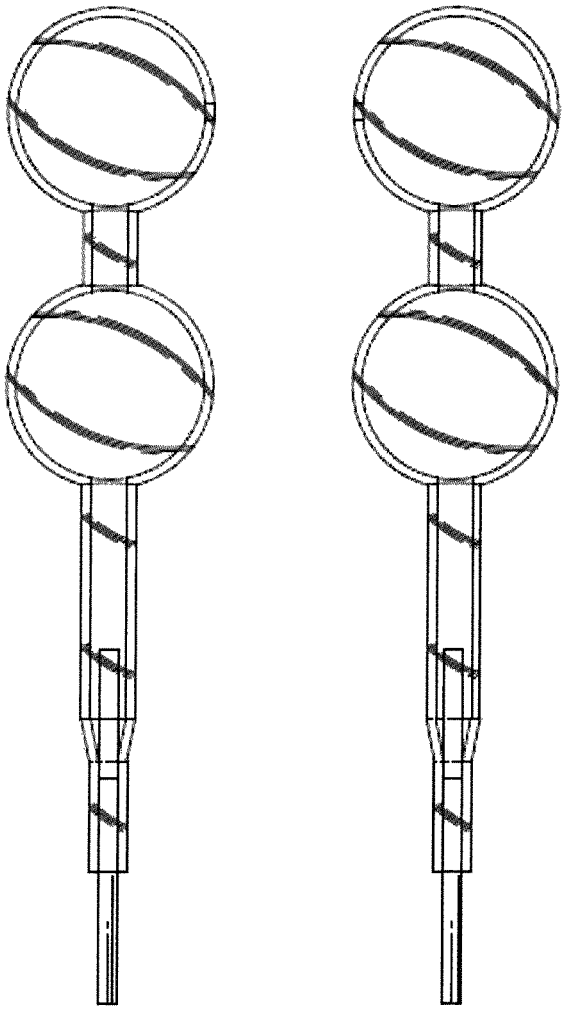

In another embodiment and as provided in FIGS. 2, 5 and 6, there is provided a pipette (1) for delivering a measured volume of liquid having:

an elongated hollow tubular body or capillary tube (2) configured to draw liquid by capillary action, the hollow tubular body having a lower open end and an upper open end; and a chamber (3) structurally connected to the upper end of the tubular body or capillary tube (2), the chamber comprising a upper bulb (3-*a*), a lower bulb (3-*c*), and a connection tube or tubular passage (3-*b*) connecting the upper bulb and the lower bulb, wherein the upper bulb has an orifice on one sidewall of the bulb;

wherein, the upper bulb and lower bulb are formed by two quadrilateral shaped sidewalls and slightly curved such that when facing each other and connected together the bulbs have quadrilateral shaped sidewalls and an oval shaped inner area; the lower bulb (3-*c*) extends to a middle tube extension (3-*c*-*i*) and continues to a bottom tube extension (3-*c*-*ii*);

the bottom tube extension (3-*c*-*ii*) being integrally united to the elongated hollow tubular body (or capillary tube) (2) at the lower end of the bottom tube extension (3-*c*-*ii*);

the connection tube or tubular passage (3-*b*) between upper bulb and lower bulb has a smaller diameter than the diameter of the bulbs;

the orifice on the one sidewall, or alternatively on both sidewalls, of the upper bulb (3-*a*) being of a diameter such that the orifice is coverable with a finger or fingertip of a user; and the elongated hollow tubular body or capillary tube (2) having a diameter and a height of a predetermined measurement such that a precise collection of from about 0.1 μL to about 200 μL of a liquid is drawn by capillary action.

Figure 15:
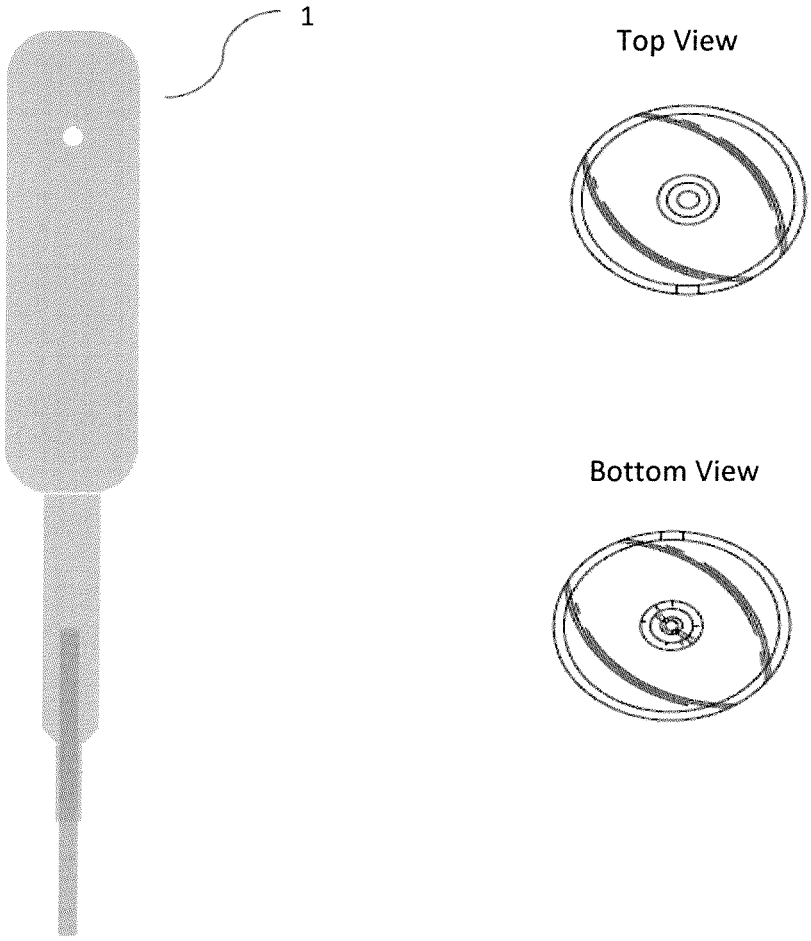
Figure 16:
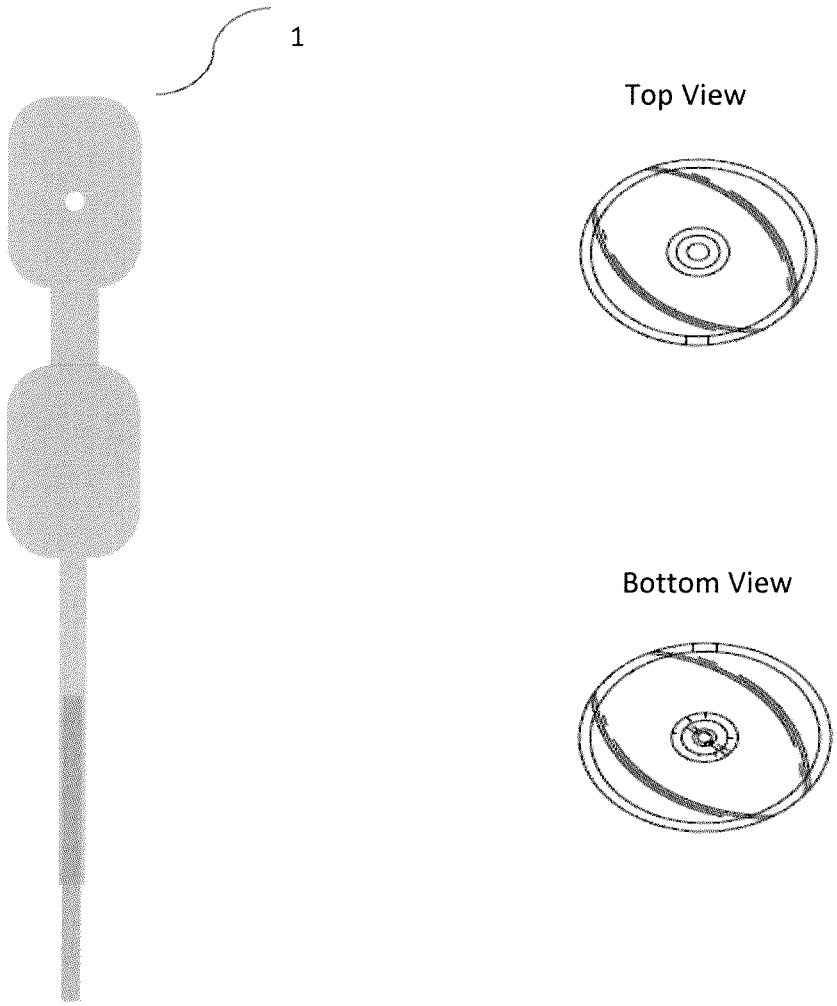

In a further embodiment and as illustrated in FIG. 16, the upper bulb and lower bulb are formed by two quadrilateral shaped sidewalls and curved such that when facing each other and connected together the bulbs have quadrilateral shaped sidewalls and a spherical shape inner area. In the embodiment as illustrated in FIG. 15, the chamber is a single bulb and formed by two quadrilateral shaped sidewalls and curved such that when facing each other and connected together the chamber has quadrilateral shaped sidewalls and a spherical or substantially spherical or globular shape inner area.

In an alternative embodiment, there is provided a pipette as described above in which the chamber has a flattened upper bulb and a flattened lower bulb. In a further alternative embodiment, the chamber has a spherical or substantially spherical upper bulb and a spherical or substantially spherical lower bulb.

In a certain embodiment, there is provided an improved volumetric dispensing pipette having an upper chamber and lower chamber, the two chambers being connected by a tubular passage, and the capillary adhesion of the contained liquid will exceed the action of gravity and retain a predetermined charge of liquid in the hollow tubular body or capillary tube which is connected to the lower chamber and which can be dispensed for the desired purpose.

The following are a few examples of the preferred embodiments of the invention:

In embodiment 1, there is provided a pipette for delivering a precisely measured volume of liquid having:

a capillary tube (2) configured to draw liquid by capillary action, the capillary tube having a lower open end and an upper open end; and a chamber (3) being structurally connected to the upper end of the capillary tube; the chamber having an orifice (4) in the upper portion of the chamber;

wherein, the chamber extends to a middle tube extension (3-*c*-*i*) and continues to a bottom tube extension (3-*c*-*ii*); the bottom tube extension being integrally united to the capillary tube at the lower end of the bottom extension;

the orifice is on one sidewall of the chamber at a selected distance from the open end; and the capillary tube has a diameter and a height of a predetermined measurement such that a precise collection of from about 0.1 μL to about 200 μL of a liquid is drawn by capillary action.

In embodiment 2, there is provided a pipette for delivering a precisely measured volume of liquid having:

a capillary tube (2) configured to draw liquid by capillary action, the capillary tube having a lower open end and an upper open end; and a chamber (3) being structurally connected to the upper end of the capillary tube; the chamber having an orifice (4) in the upper portion of the chamber;

wherein, the chamber extends to a bottom tube extension (3-*c*-*ii*); the bottom tube extension being integrally united to the capillary tube at the lower end of the bottom extension;

the orifice is on one sidewall of the chamber at a selected distance from the open end; and the capillary tube has a diameter and a height of a predetermined measurement such that a precise collection of from about 0.1 μL to about 200 μL of a liquid is drawn by capillary action.

In embodiment 3, there is provided a pipette according to embodiment 1 or 2, wherein the chamber is round or globular shape.

In embodiment 4, there is provided a pipette for delivering a measured volume of liquid having:

a capillary tube (2) configured to draw liquid by capillary action, the capillary tube having a lower open end and an upper open end; and a chamber (3) being structurally connected to the upper end of the capillary tube, the chamber comprising an upper bulb and a lower bulb connected by a connection tube, wherein the upper bulb comprises an orifice;

wherein, the chamber extends to a middle tube extension and continues to a bottom tube extension, the bottom tube extension being integrally united to the capillary tube at the lower end of the bottom extension;

the orifice is made through one sidewall of the upper bulb of the chamber; and the capillary tube has a diameter and a height of a predetermined measurement such that a precise collection of from about 0.1 μL to about 200 μL of a liquid is drawn by capillary action.

In embodiment 5, there is provided a pipette for delivering a measured volume of liquid having:

a capillary tube (2) configured to draw liquid by capillary action, the capillary tube having a lower open end and an upper open end; and a chamber (3) being structurally connected to the upper end of the capillary tube, the chamber comprising an upper bulb and a lower bulb connected by a connection tube, wherein the upper bulb comprises an orifice;

wherein, the chamber extends to a bottom tube extension, the bottom tube extension being integrally united to the capillary tube at the lower end of the bottom extension;

the orifice is made through one sidewall of the upper bulb of the chamber; and the capillary tube has a diameter and a height of a predetermined measurement such that a precise collection of from about 0.1 μL to about 200 μL of a liquid is drawn by capillary action.

In embodiment 6, there is provided a pipette according to embodiment 4 or 5, wherein the upper bulb and the lower bulb are of a substantially round or globular shape.

In embodiment 7, there is provided a pipette according to embodiment 4 or 5 wherein the upper bulb and the lower bulb of the chamber each have a diameter of 0.7 cm and a height of 1.0 cm.

In embodiment 8, there is provided a pipette according to embodiment 4, wherein the connection tube has a diameter of 0.25 cm and a height of 0.4 cm.

In embodiment 9, there is provided a pipette according to embodiment 4, wherein the middle tube extension has a diameter of 0.3 cm and a height of 1.3 cm and the bottom tube extension has a diameter of about 0.2 cm and a height of about 0.4 1.0 cm.

In embodiment 10, there is provided a pipette (1) for delivering a measured volume of liquid having:

an elongated hollow tubular body (2) configured to draw liquid by capillary action, the hollow tubular body having a lower open end and an upper open end; and a chamber (3) structurally connected to the upper end of the tubular body (2); the chamber comprising two quadrilateral shaped sidewalls slightly curved such that when the sidewalls are facing each other and connected together by all four corners of the quadrilateral shaped sidewalls, the chamber has quadrilateral shaped sidewalls and an oval shaped inner area;

wherein, there is an orifice in the upper portion of one sidewall of the chamber;

the chamber extends to a middle tube extension and continues to a bottom tube extension; the bottom tube extension being integrally united to said capillary tube at the lower end of said bottom extension;

the orifice on the one sidewall of the chamber being of a diameter such that the orifice is coverable with a finger or fingertip of the user; and the elongated hollow tubular body (or capillary tube) (2) having a diameter and a height of a predetermined measurement such that a precise collection of from about 0.1 μL to about 200 μL of a liquid is drawn by capillary action.

In embodiment 11, there is provided a pipette according to embodiment 10, wherein the chamber extends directly to the bottom tube extension.

In embodiment 12, there is provided a pipette (1) for delivering a measured volume of liquid having:

an elongated hollow tubular body (or capillary tube) (2) configured to draw liquid by capillary action, the hollow tubular body having a lower open end and an upper open end; and a chamber (3) structurally connected to the upper end of the tubular body (or capillary tube) (2), the chamber comprising a upper bulb (3-*a*), a lower sample collecting bulb (3-*c*), and a tubular passage (or connection tube) (3-*b*) connecting the upper bulb and the lower bulb, wherein the upper bulb has an orifice on one sidewall of the bulb;

wherein, the upper bulb and lower bulb are formed by quadrilateral shaped sidewalls slightly curved such that when the sidewalk are facing each other and connected together by all four corners of the quadrilateral shaped sidewalls, the chamber has quadrilateral shaped sidewalk and an oval shaped inner area;

the lower bulb (3-*c*) extends to a middle tube extension (3-*c*-*i*) and continues to a bottom tube extension (3-*c*-*ii*); the bottom tube extension (3-*c*-*ii*) being integrally united to the elongated hollow tubular body (or capillary tube) (2) at the lower end of the bottom tube extension (3-*c*-*ii*);

the orifice on the one sidewall of the upper bulb (3-*a*) being of a diameter such that the orifice is coverable with a finger or fingertip of the user; and the elongated hollow tubular body (or capillary tube) (2) having a diameter and a height of a predetermined measurement such that a precise collection of from about 0.1 μL to about 200 μL of a liquid is drawn by capillary action.

In embodiment 12b, there is provided a pipette substantially as described above and as provided in FIGS. 13 and 14 wherein the upper and lower bulbs are quadrilateral shaped and the chamber extends directly to a bottom tube extension.

In embodiment 13, there is provided the pipette according to any one of embodiments 1, 2 10 or 11, further having an orifice on the opposite sidewall of the chamber so that both sidewalls of the chamber have an orifice.

In embodiment 14, there is provided a pipette according to any one of embodiments 4, 5 or 12 and 12b, further having an orifice on the opposite sidewall of the chamber so that both sidewalls of the chamber have an orifice.

In embodiment 16, there is provided a pipette according to any one of embodiments 1, 2, 4, 5, 10 or 12, wherein the diameter and the height of the capillary tube are such that a collection of 2 μL of a liquid is drawn by capillary action.

In embodiment 17, there is provided a pipette according to any one of embodiments 1, 2, 4, 5, 10 or 12, wherein the diameter of the capillary tube is 0.1 cm and the height of the capillary tube is 1.6 cm such that a collection of 2 μL of a liquid is drawn by capillary action.

In embodiment 18, there is provided a pipette according to any one of embodiments 1, 2 or 10, wherein the chamber has a diameter of 0.7 cm and a height of 2.4 cm.

In embodiment 19, there is provided a pipette according to any one of embodiments 1, 2, 4, 5, 10 or 12, wherein the inner diameter of the capillary tube is 0.04 cm and the outer diameter of the capillary tube is 0.1 cm and the height of the capillary tube is 1.6 cm such that a collection of 2 μL of a liquid is drawn by capillary action.

In embodiment 20, there is provided a pipette according to any one of embodiments 1, 2, 4, 5, 10 or 12, wherein the capillary tube having a diameter and a height of a predetermined measurement such that a precise collection of from about 2 μL to about 20 μL of a liquid is drawn by capillary action.

The body of the pipette may be formed of glass or other suitable materials such as wax, plastic, or the like which do not have any reaction with the liquid being used. The units of the present invention may also be fabricated of moldable material such as plastic, thereby being economically manufactured and disposable The units of the present invention can be made of hydrophobic material, e.g. plastic, such as Teflon, polypropylene, polyethylene, etc., where liquid will not adhere thereto. Depending on the liquid, this assures complete discharge of the contents of the tube portion of the pipette, and this could become an important factor from the viewpoint of accuracy, particularly where minute volumes are involved.

In another embodiment, the capillary tube may be glass or other hydrophilic material. In a certain embodiment, the interior surface of the capillary tube can be coated with anticoagulant. However, it should be appreciated that the pipette of the present invention is not to be restricted to the specific materials exemplified herein and that one of ordinary skill in the art would know that any material which can hold a liquid solution can be used.

In a further embodiment, the units of the present invention may be fabricated of moldable material such as plastic, and so economically as to place them in the category of disposable items.

The diameter of the capillary tube will vary with the material of which the tube is made, the surface tension and specific gravity of the liquid and the amount of capillary attraction necessary to sustain a desired amount of liquid.

In another embodiment, the capillary tube is molded as a separate element and adapted to be secured to the chamber properly by a frictional and bonded by, such as glue or heat treatment, in a leakproof assembled relationship connection. In molding the chamber integral with the capillary tube, not only is leakage prevented, but it renders it impossible to remove the chamber for use with another capillary tube, which practice could conceivably lead to contamination.

In one embodiment, the capillary tube is fixed to the bottom tube extension of the chamber via melting by heating the plastic part of the chamber. In this connection, the elements are assembled in a leakproof relationship to retain the elements in a leakproof assembly relationship.

To maximize the utility and advantage of this feature, the chamber and tube can be made of a clear or translucent material, whereby one may, by casual observation, limit the extent of overflow.

In operation, the tip of the pipette is immersed in the liquid to be measured with the vent (orifice) open. The chamber/bulb can be compressed if necessary when the capillary power is not sufficiently enough for the sample to be drawn in. The vent must be open in order for the capillary tube to suck the liquid in to the capillary tube (2). When the open end of the tube is placed against the source of the liquid, the liquid will enter the tube by capillary action. As liquid enters the tube air within the tube will escape from the hole in the sidewall. Accordingly, the lower bulb in the two bulb chamber configuration of the present invention assists the capillary action, by adding air pressure, if the capillary action itself cannot collect enough sample.

To dispense the liquid, one closes the orifice or hole. This is one of the advantages conferred by the present invention. By closing this orifice through a simple placement of a finger over the orifice, the liquid sample can be easily released. This orifice in fact aids in the efficient use of the capillary power. Without the orifice, air pressure produced in the tube is not able to be released and the capillary tube cannot suck the sample through the capillary tube. The orifice is made through the sidewall of the chamber at a selected distance from the open end. The hole should be sized so as to be completely and easily coverable by a finger. The diameter of this orifice can be, for example, about 0.1 cm, but can be of any size smaller than the surface of a finger and sufficiently large so that air can flow through the hole.

In a certain embodiment and as provided, for example, in FIG. 2, the capillary tube 2 extends into the chamber 3 a short distance, to form an extension 2-*i*. This configuration provides an important advantage, in that the total capillary tube 2 including the extension 2-*i*, may be utilized as a precise measuring unit, by drawing in the exact amount of liquid or sufficient liquid to produce a slight overflow. In the case where a slight overflow is produced, the excess will spill over into the middle tube extension part of the chamber, and only that volume within the capillary tube 2 may be discharged upon closing and pressing the orifice in the upper bulb of the chamber. Thus, a precise and exact measurement of liquid can be realized even without the exercise of appreciable care.

From the foregoing description, it will be apparent that the present invention is subject to some alteration and modification without departing from the underlying principles involved. It is not meant to be limited to the examples as illustrated and described herein but to include all equivalents thereof.

We claim:

1. A pipette for delivering a measured volume of liquid comprising:

an elongated hollow tubular body configured to draw liquid by capillary action, the hollow tubular body having a lower open end and an upper open end; and a chamber connected to a middle part between the lower open end and the upper open end of the tubular body, wherein the tubular body extends from the middle part into the chamber and the upper open end of the tubular body is located inside the chamber so that an overflow from the tubular body can spill over into the chamber, wherein the chamber is compressible to dispense the liquid, and wherein the upper open end of the tubular body is spaced apart from other components of the pipette, and wherein, (i) the chamber extends to a middle tube extension and continues to a bottom tube extension; the bottom tube extension being integrally united to the tubular body at the lower end of the bottom extension; or (ii) the chamber extends to a bottom tube extension; the bottom tube extension being integrally united to the tubular body at the lower end of the bottom extension.

2. The pipette according to claim 1, wherein the chamber extends directly to a bottom tube extension.

3. The pipette according to claim 1, further comprising orifices sidewalls of the chamber.

4. The pipette according to claim 1, wherein the chamber extends directly to a bottom tube extension and further comprising orifices on sidewalls of the chamber.

5. The pipette according to claim 1, wherein the diameter and the height of the capillary tube are such that a collection of 2 μL of a liquid is drawn by capillary action.

6. The pipette according to claim 1, wherein the diameter of the capillary tube is 0.1 cm and the height of the capillary tube is 1.6 cm such that a collection of 2 μL of a liquid is drawn by capillary action.

7. The pipette according to claim 1, wherein the chamber has a diameter of 0.7 cm and a height of 2.4 cm.

8. The pipette according to claim 1, wherein the inner diameter of the capillary tube is 0.04 cm and the outer diameter of the capillary tube is 0.1 cm and the height of the capillary tube is 1.6 cm such that a collection of 2 μL of a liquid is drawn by capillary action.

9. The pipette according to claim 1, wherein the capillary tube having a diameter and a height of a predetermined measurement such that a precise collection of from about 2 μL to about 20 μL of a liquid is drawn by capillary action.

10. The pipette according to claim 1, wherein the chamber comprises two quadrilateral shaped sidewalls slightly curved such that when the sidewalls are facing each other and connected together by all four corners of the quadrilateral shaped sidewalls, the chamber has quadrilateral shaped sidewalls and an oval shaped inner area; wherein, there is an orifice in the upper portion of one sidewall of the chamber; the chamber extends to a middle tube extension and continues to a bottom tube extension; the bottom tube extension being integrally united to said capillary tube at the lower end of said bottom extension; the orifice on the one sidewall of the chamber being of a diameter such that the orifice is coverable with a finger or fingertip of the user; and the elongated hollow tubular body (or capillary tube) having a diameter and a height of a predetermined measurement such that a precise collection of from about 0.1 μL to about 200 μL of a liquid is drawn by capillary action.

11. The pipette according to claim 1, wherein the chamber comprises a upper bulb, a lower sample collecting bulb, and a tubular passage (or connection tube) connecting the upper bulb and the lower bulb, wherein the upper bulb has an orifice on one sidewall of the bulb; the upper bulb and lower bulb are formed by quadrilateral shaped sidewalls slightly curved such that when the sidewalls are facing each other and connected together by all four corners of the quadrilateral shaped sidewalls, the chamber has quadrilateral shaped sidewalls and an oval shaped inner area; the lower bulb extends to a middle tube extension and continues to a bottom tube extension; the bottom tube extension being integrally united to the elongated hollow tubular body (or capillary tube) at the lower end of the bottom tube extension; the orifice on the one sidewall of the upper bulb being of a diameter such that the orifice is coverable with a finger or fingertip of the user; and the elongated hollow tubular body (or capillary tube) having a diameter and a height of a predetermined measurement such that a precise collection of from about 0.1 μL to about 200 μL of a liquid is drawn by capillary action.

12. The pipette according to claim 1, consisting of the elongated hollow tubular body and the chamber.

13. A pipette for delivering a precisely measured volume of liquid comprising:

a capillary tube configured to draw liquid by capillary action, the capillary tube having a lower open end and an upper open end; and a chamber being connected to a middle part between the lower open end and the upper open end of the capillary tube, wherein the tubular body extends from the middle part into the chamber and the upper open end of the tubular body is located inside the chamber so that an overflow from the tubular body can spill over into the chamber; the chamber having an orifice in the upper portion of the chamber;

wherein the chamber is compressible to dispense the liquid, wherein the upper open end of the capillary tube is spaced apart from other components of the pipette, and wherein, (i) the chamber extends to a middle tube extension and continues to a bottom tube extension; the bottom tube extension being integrally united to the capillary tube at the lower end of the bottom extension; the orifice is on one sidewall of the chamber at a selected distance from the open end; and the capillary tube has a diameter and a height of a predetermined measurement such that a precise collection of from about 0.1 μL to about 200 μL of a liquid is drawn by capillary action; or (ii) the chamber extends to a bottom tube extension; the bottom tube extension being integrally united to the capillary tube at the lower end of the bottom extension; the orifice is on one sidewall of the chamber at a selected distance from the open end; and the capillary tube has a diameter and a height of a predetermined measurement such that a precise collection of from about 0.1 μL to about 200 μL of a liquid is drawn by capillary action.

14. The pipette according to claim 13, wherein the chamber is round or globular shape.

15. A pipette for delivering a measured volume of liquid comprising:

a capillary tube configured to draw liquid by capillary action, the capillary tube having a lower open end and an upper open end; and a chamber being connected to a middle part between the lower open end and the upper open end of the capillary tube, the chamber comprising an upper bulb and a lower bulb connected by a connection tube, wherein the capillary tube extends from the middle part into the chamber and the upper open end of the capillary tube is located inside the chamber so that an overflow from the tubular body can spill over into the chamber and wherein the upper bulb comprises an orifice;

wherein the chamber is compressible to dispense the liquid, wherein the upper open end of the capillary tube is spaced apart from other components of the pipette, and wherein, (i) the chamber extends to a middle tube extension and continues to a bottom tube extension, the bottom tube extension being integrally united to the capillary tube at the lower end of the bottom extension; the orifice is made through one sidewall of the upper bulb of the chamber; and the capillary tube has a diameter and a height of a predetermined measurement such that a precise collection of from about 0.1 μL to about 200 μL of a liquid is drawn by capillary action; or (ii) the chamber extends to a bottom tube extension, the bottom tube extension being integrally united to the capillary tube at the lower end of the bottom extension; the orifice is made through one sidewall of the upper bulb of the chamber; and the capillary tube has a diameter and a height of a predetermined measurement such that a precise collection of from about 0.1 μL to about 200 μL of a liquid is drawn by capillary action.

16. The pipette according to claim 15, wherein the upper bulb and the lower bulb are of a substantially round or globular shape.

17. The pipette according to claim 15, wherein the upper bulb and the lower bulb of the chamber each has a diameter of 0.7 cm and a height of 1.0 cm.

18. The pipette according to claim 15, wherein the connection tube has a diameter of 0.25 cm and a height of 0.4 cm.

19. The pipette according to claim 15, wherein the middle tube extension has a diameter of 0.3 cm and a height of 1.3 cm and the bottom tube extension has a diameter of about 0.2 cm and a height of about 0.4 cm.

20. The pipette according to claim 15, further comprising an orifice on the opposite sidewall of the chamber so that both sidewalls of the chamber have an orifice.

* * * * *